US009931854B2

(12) United States Patent
Woodlock et al.

(10) Patent No.: US 9,931,854 B2
(45) Date of Patent: Apr. 3, 2018

(54) INSTALLING A PEN IN IMAGING DEVICES

(71) Applicant: HEWLETT-PACKARD DEVELOPMENT COMPANY, L.P., Houston, TX (US)

(72) Inventors: David Woodlock, Vancouver, WA (US); Mark G. Miranda, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/114,170

(22) PCT Filed: Jan. 31, 2014

(86) PCT No.: PCT/US2014/014183

§ 371 (c)(1),
(2) Date: Jul. 26, 2016

(87) PCT Pub. No.: WO2015/116172

PCT Pub. Date: Aug. 6, 2015

(65) Prior Publication Data

US 2017/0232751 A1 Aug. 17, 2017

(51) Int. Cl.

| | |
|---|---|
| ***B41J 2/175*** | (2006.01) |
| ***B41J 29/02*** | (2006.01) |
| ***B41J 29/13*** | (2006.01) |

(52) U.S. Cl.
CPC ..... *B41J 2/1752* (2013.01); *B41J 2/17553* (2013.01); *B41J 29/02* (2013.01); *B41J 29/13* (2013.01)

(58) Field of Classification Search
CPC ..... B41J 2/1752
See application file for complete search history.

(56) References Cited

U.S. PATENT DOCUMENTS

2009/0195625 A1* 8/2009 Sekino ..... B41J 2/17513 347/87

* cited by examiner

*Primary Examiner* — Kristal Feggins
*Assistant Examiner* — Kendrick Liu
(74) *Attorney, Agent, or Firm* — Hanley Flight & Zimmerman LLC

(57) ABSTRACT

A disclosed example apparatus to install a pen in an imaging device includes a first guide on a first component of the imaging device to guide the pen in a first direction toward a second component of the imaging device during installation of the pen in the imaging device. The example apparatus also includes a second guide on the second component to receive the pen from the first guide during the installation of the pen. The first guide and the second guide define a gap therebetween and at least one of the first and second guides causes the pen to pass the gap without catching. The second guide is to guide the pen into an installed position in the second component.

16 Claims, 7 Drawing Sheets

INSTALLING A PEN IN IMAGING DEVICES

BACKGROUND

Imaging devices require replacement of pens (e.g., ink cartridges). The ink of such pens are depleted over time and must be replaced to continue operation of the imaging device. Often, installation/replacement of a pen (e.g., a printer ink cartridge) into an imaging device (e.g., printer, scanner, etc.) involves relatively complex manipulation of the pen.

Figure 1:
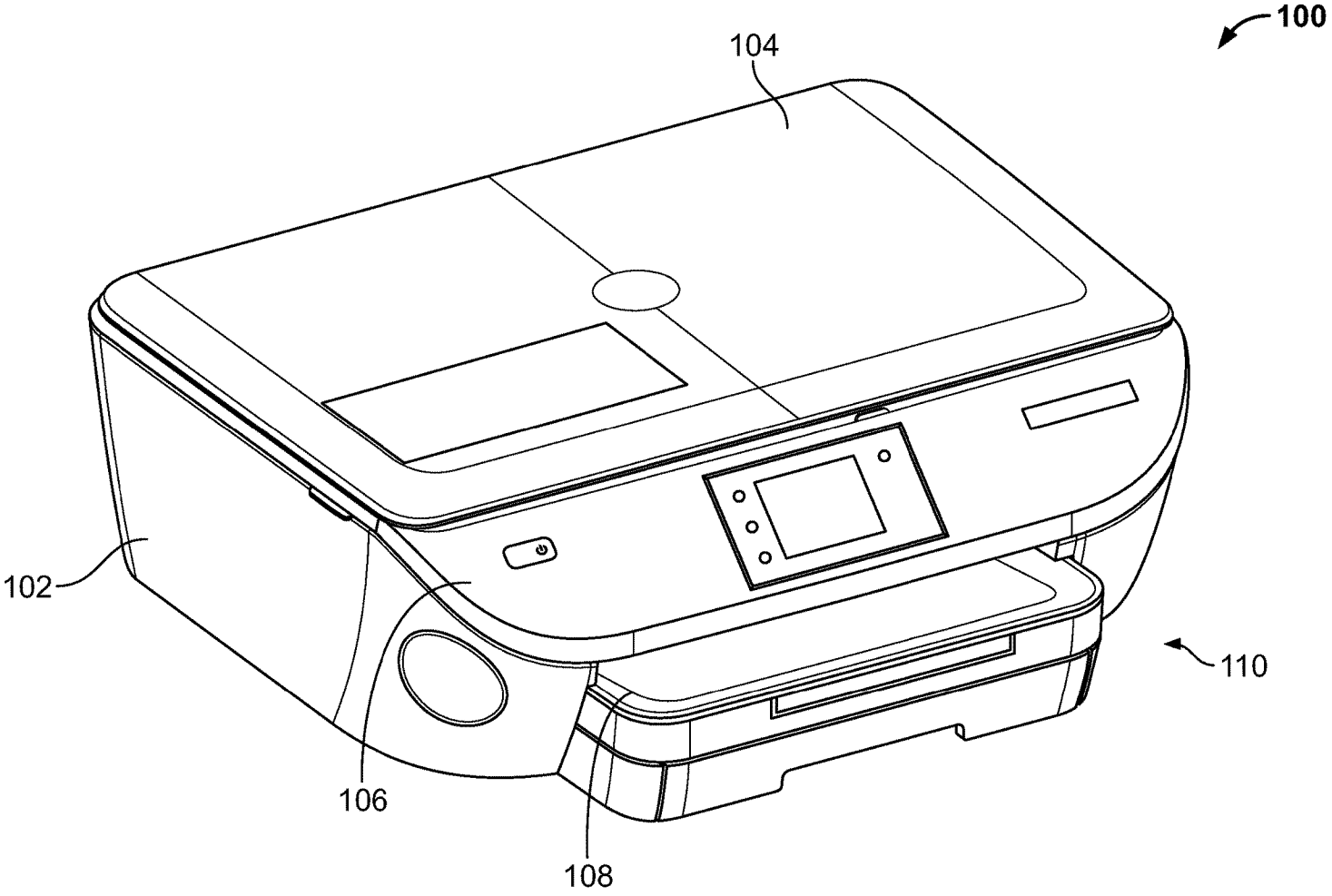
FIG. 1 illustrates an example imaging device.

The figures are not to scale. Wherever possible, the same reference numbers will be used throughout the drawing(s) and accompanying written description to refer to the same or like parts. As used in this patent, stating that any part (e.g., a layer, a part, film, area, or plate) is in any way positioned on (e.g., positioned on, located on, disposed on, formed on, etc.) another part, means that the referenced part is either in contact with the other part, or that the referenced part is above the other part (relative to Earth) with one or more intermediate part(s) located therebetween. Stating that any part is in contact with another part means that there is no intermediate part between the two parts.

DETAILED DESCRIPTION

In known imaging systems, installation of a pen into a front-loading imaging device requires specifically designed openings and/or clearance areas to enable insertion of the pen to a pen receptacle and/or installation position of the imaging device. In such known systems, these openings require the user to place a pen in a relatively small target zone, which may be difficult. Additionally or alternatively, the small target zone may not be easily accessible to the user. These openings and/or clearance areas may require increased manufacturing cost, increased design complexity, and/or unnecessarily constrain the design of the imaging device (e.g., impose a requirement for a significantly large clearance opening designated for loading the pen into the imaging device that may have been used instead to incorporate other design features). These openings and/or clearance areas may also diminish the overall aesthetic of the imaging device. In other known systems, installation requires a lever or latch on the pen to either facilitate a kinematic motion to install the pen into the imaging device or to provide the necessary application of force to seat the pen in the installation position. Such latches and/or levers require significant manufacturing cost, complexity and/or additional parts and features in the imaging device to receive the pen. Pens with latches or levers may confuse the user as to how to assemble the pen into the imaging device. Often, installation of these pens requires multiple steps and/or counter-intuitive manipulation.

Apparatus, methods, and articles of manufacture to install pens in imaging devices are disclosed herein. Some such examples reduce cost of the imaging device and/or pen, reduce complexity of the imaging device and/or pen, and/or improve the user experience by increasing the ease of installation of a pen in an imaging device. Some example installation systems disclosed herein have a first guide (e.g., a guide rail) on a first component (e.g., a printer chassis) of an imaging device and a second guide (e.g., a second guide rail) on a second component (e.g., a printer carriage or a pen chute) of the imaging device to guide a pen into an installation position in the imaging device. In some examples, the first guide has a geometry structured to guide the pen in a first direction towards the second component of the imaging device during installation of the pen in the imaging device. In some examples, the first and second guides are separated by a gap. However, the first and second guides have a geometry to enable the pen to move from the first guide and onto the second guide without catching on the gap. In some examples, the second guide receives the pen from the first guide and guides the pen into an installed position in the second component. The geometry of at least one of the first and second guides causes the pen to pass the gap without catching. The second guide of some disclosed examples has a geometry to guide the pen into an installed position in the second component. In some example installation systems disclosed herein, the geometry of the first or second guide includes a surface (e.g., a ramp) to engage a surface (e.g., a tab) of the pen in order to urge the pen to transition from the first guide onto the second guide. In such examples, the positional arrangement of the first and second guides in relation to the gap allows the pen to transition from the first guide to the second guide with relative ease of assembly for the user. The transition may involve directional changes of the pen without the user significantly manipulating the pen.

Examples disclosed herein reduce (e.g., minimize) the need to have complex and expensive latching systems such as those known in the art. Such known systems may require additional parts and/or complexity, and may be difficult to manipulate or confusing to the end user. Eliminating such systems results in improved ease of installation of pens and, thus, an improved end user experience. Improved ease of installation may result in decreased returns and/or service calls related to the imaging device and/or pens. Additionally, examples disclosed herein reduce (e.g., eliminate) the need for complex openings (e.g., openings in the front of the imaging device), to access a pen receiving portion of an imaging device. Examples disclosed herein allow a pen to be inserted into an imaging device at a user-friendly location while reducing (e.g., minimizing) the manipulation necessary to install the pen into the imaging device.

Turning to FIG. 1, an example imaging device 100 (e.g., a printer) is shown. The example imaging device 100 of FIG. 1 has a base 102, a scan lid 104, a front panel 106 and a paper tray 108. The base 102 provides structure for the imaging device 100 and a housing for the components within. In the illustrated example, the lid 104 swivels relative to the base 102 to allow a user access to scanning functions of the imaging device 100. The front panel 106 in the illustrated example displays information to a user. In some examples, the front panel 106 also swivels open to expose internal components, such as those described in greater detail in connection with FIGS. 2-8C. The paper tray 108 in the illustrated example may be removed from the base 102 to, for example, install paper in the device.

Figure 2:
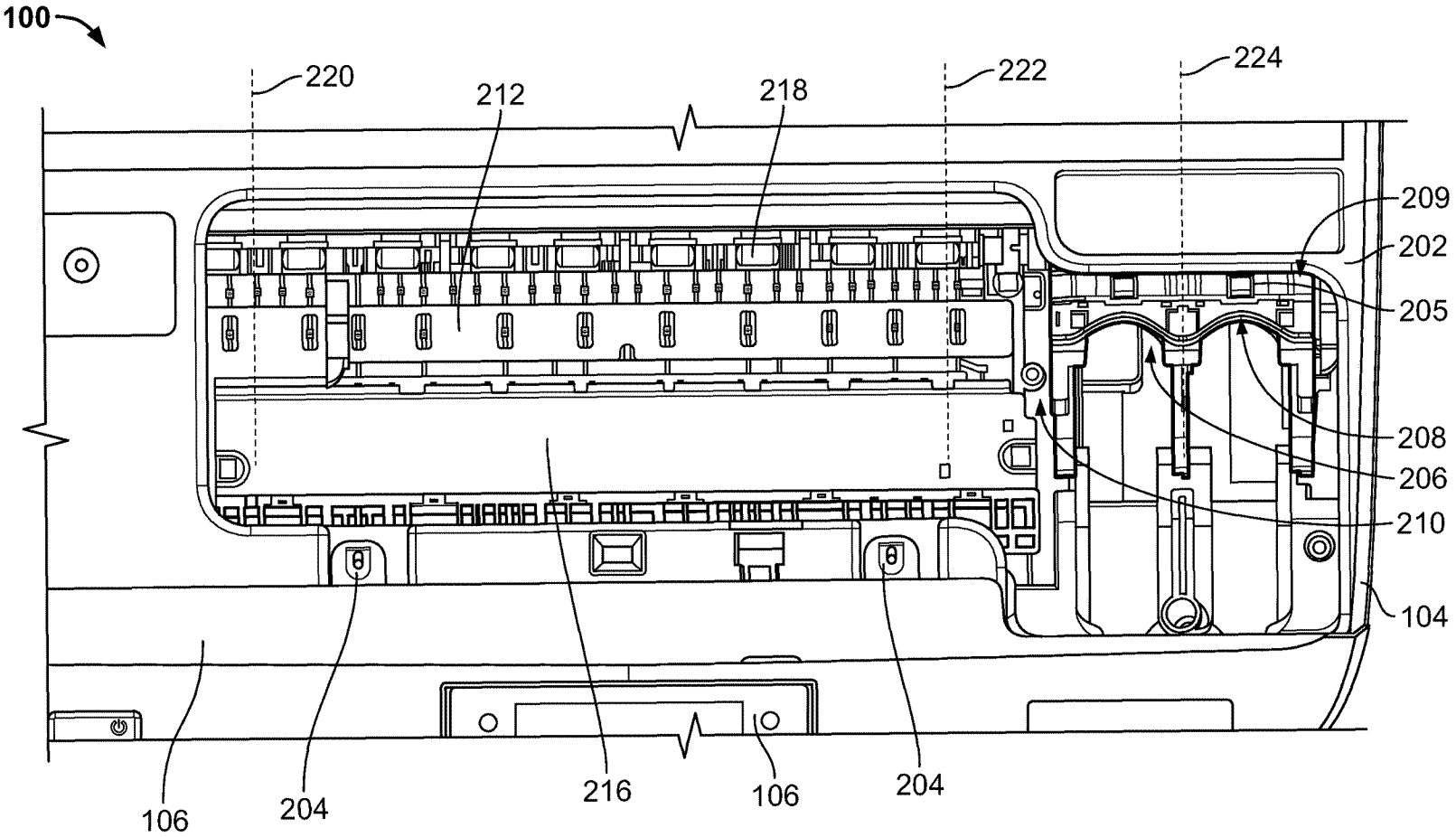
FIG. 2 is a top view of a portion of the example imaging device of FIG. 1.

FIG. 2 is a top, partially disassembled view of a portion of the front panel 106 of the example imaging device 100 of FIG. 1. In the example of FIG. 2, a scanner of the imaging device 100 has been removed to illustrate example internal components of the imaging device 100. In the example of FIG. 2, a chassis 202 is coupled to the front panel 106 through conventional fasteners (e.g., screws, rivets, etc.) at tabs 204. A movable carriage 205, which is positioned in a loading position in the example of FIG. 2, contains pen chutes 206, 208 to receive pens (e.g., ink cartridges, pen assemblies). In the example of FIG. 2, the carriage 205 and the chassis 202 comprise an example installation system 209 constructed in accordance with the teachings of this disclosure for installation of pens into the imaging device 100. A bottom surface 210 of the base 102 has a platen absorber 212 and an output assembly 216 mounted onto it. In the example of FIG. 2, an upper paper guide 218 is mounted to the base 102 and is used to direct paper within the imaging device 100.

During imaging operations (e.g., printing), the carriage 205 of the illustrated example moves between a first position 220 and a second position 222 to position the pen in location(s) appropriate for printing. During installation and/or removal of one or more pens from the example carriage 205, the carriage 205 of FIG. 2 moves to a third position 224 to receive one or more new pens and/or position one or more old pens for removal. The movement of the printer carriage 205 to the third position 224 may result from, for example, the user interacting with the front panel 106 or may be automatically triggered by a condition of one or more of the pens (e.g., low ink content in any of the pens and/or incorrect pen installed, etc.). Installation and removal of example pens will be described in greater detail below in connection with FIGS. 3-8C.

Figure 3:
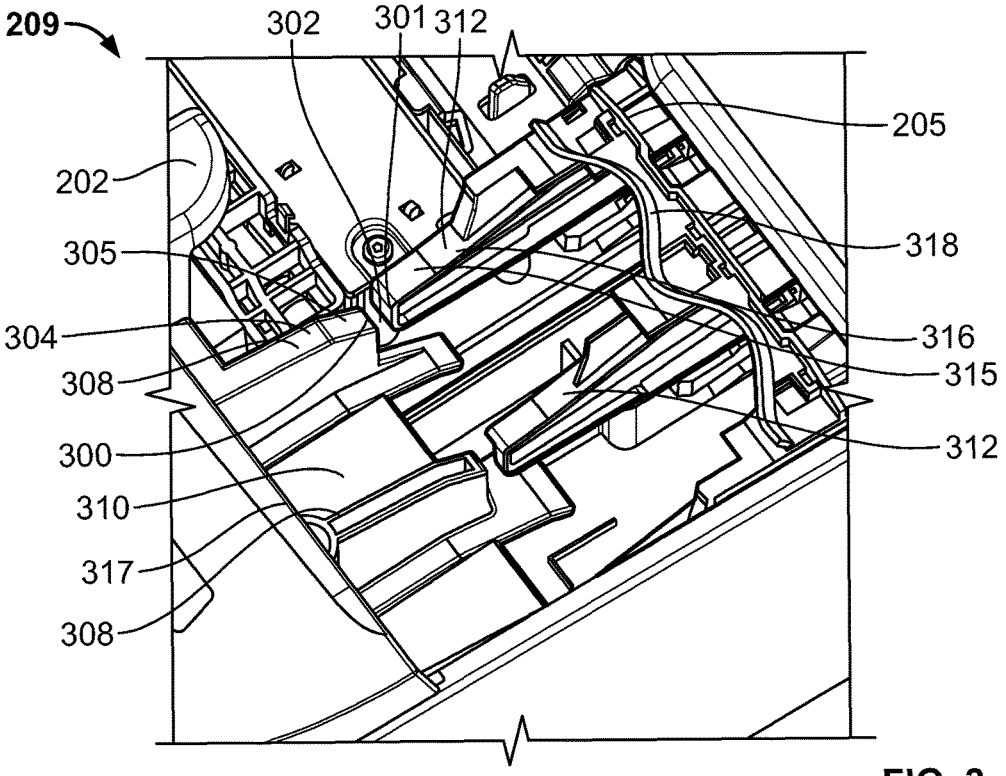
FIG. 3 is an enlarged view of a portion of FIG. 2 illustrating an example installation system constructed in accordance with the teachings of this disclosure.

FIG. 3 is an enlarged view of a portion of FIG. 2 illustrating the example installation system 209 of FIG. 2. Although the example installation system 209 is shown in the example imaging device 100 of FIGS. 1 and 2, it can be used in other imaging devices having other form factors, features and/or functions. In the example of FIG. 3, the carriage 205 is positioned relative to the chassis 202 in the pen loading position for installation and/or removal of one or more pens. In other words, the carriage 205 is located in the third position 224 described also in connection with FIG. 2. As explained in connection with FIG. 2, the carriage 205 moves between first and second positions 220, 222 relative to the chassis 202 during imaging operations of the imaging device 100. In the pen installation position of FIG. 3 (e.g., the third loading position 224 different from the first and second positions 220, 222), a downwardly angled tip 300 of a first guide of the chassis 202 and an upwardly angled tip 301 of a second guide of the carriage 205 are separated by a gap 302. As used herein, all positional references are relative to the Earth and relative to an example device positioned on a flat surface. The chassis 202 of the illustrated example has one or more first guides (e.g., guide rails, rails, guiding surfaces, guiding edges, etc.) 308, which in this example are integrated onto the chassis 202 (e.g., molded). The first guides 308 have a geometric construction to guide a pen in a first direction towards the carriage 205 during installation of the pen. In particular, a first top surface of the first guides 308 includes a first downwardly sloped surface 304 having a first slope. A second downwardly sloped surface 305 of the first guides 308 has a second slope greater than the first slope. The first guides 308 also include the downwardly angled tip 300 located at the distal end of the second downwardly sloped surface 305. In the illustrated example, the second slope of the second downwardly sloped surface 305 has a steeper angle relative to horizontal than the first slope of the first downwardly sloped surface 304. Further, "downwardly" in this example means dropping in vertical height from left to right in FIGS. 8A-8C (e.g., toward the installed position). The chassis 202 of the illustrated example has a contact surface 310 positioned for the pen to initially contact as the pen is being placed into the installation system 209.

In the example of FIG. 3, the carriage 205 has one or more second guides 312 to receive the pen from the first guides 308 of the chassis 202 to guide the pen into one of the chutes 206, 208 defined in the carriage 205 for imaging operations. Each top surface of the second guides 312 of the carriage 205 includes a first upwardly sloped surface 315 having a third slope, a second upwardly sloped surface 316 having a fourth slope greater than the third slope, and the upwardly angled tip 301 at the distal end of the first upwardly sloped surface 315. In the illustrated example, the third slope of the first upwardly sloped surface 315 has a steeper angle relative to horizontal than the fourth slope of the second upwardly sloped surface 316. "Upwardly" means increasing in vertical height moving from left to right in FIGS. 8A-8C (e.g., toward the installed position). The geometric construction and spatial arrangement of the first guides 308 of the chassis 202 and the second guides 312 of the carriage 205 directs the pen to move across the gap 302 without catching and without requiring special manipulation to a user. Instead, a user need only apply a force with a generally horizontal component to the pen and the guides 308, 312 will not control the movement of the pen as it progresses toward the installed position. In the illustrated example, the contact surface 310 of the chassis 202 is integral to the chassis 202 and the second guides 312 are integral to the carriage 205. In the illustrated example, the upwardly angled tip 301 of the carriage 205 and/or the downwardly angled tip 300 of the chassis 202 have a rounded edge to further increase the smoothness of the transition of a pen into its installed position. The rounded edge of the upwardly angled tip 301 is shown in greater detail in connection with FIG. 6.

In the illustrated example, an opening 317 of the chassis 202 provides an insertion/removal location for a pen to be installed or removed from into the example imaging device 100. This opening 317 is located in a user-accessible location and orientation. In the illustrated example, the carriage 205 has contours 318 to facilitate removal of the pen from the carriage 205 by increasing user access to the installed pen.

Figure 4:
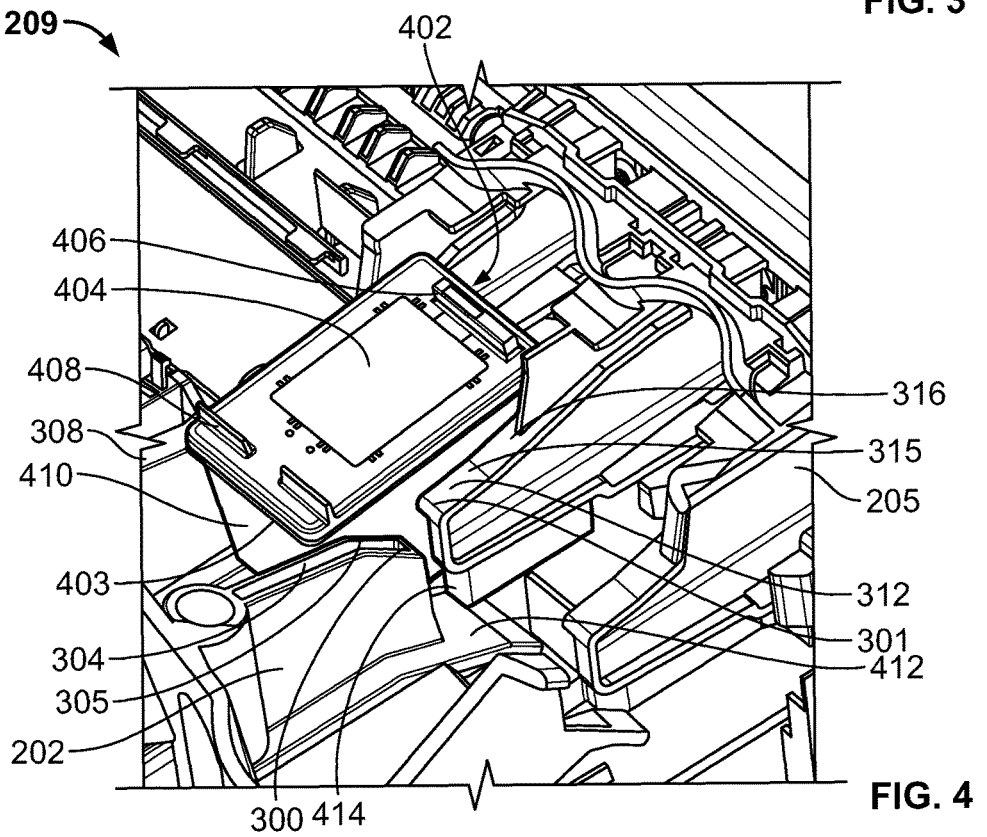
FIG. 4 illustrates the example installation system of FIG. 3 showing an example pen moving into an installed position.

FIG. 4 is illustrates the example installation system 209 of FIG. 3 showing an example pen 402 moving into an installed position. In the example of FIG. 4, the pen 402 is shown in an intermediate position as it transitions from the chassis 202 (e.g., passing over the gap 302) to the movable carriage 205. An edge 403 of the pen 402 first contacts and is guided downward by the first downwardly sloped surface 304 of the first guides 308, and then moves to the second downwardly sloped surface 305 to be guided further downward towards the base 102 of the imaging device 100 and the downwardly angled tip 300 before traversing the gap 302 and passing onto the top of the first upwardly sloped surface 315 of the second guides 312 of the carriage 205. As the pen 402 moves onto the second guides 312 of the carriage 205 and into the installation position, the edge 403 passes or contacts the upwardly angled tip 301 of the second guides 312 and then moves in an upward direction along the first upwardly sloped surface 315 and then on to the second upwardly sloped surface 316. To move the pen 402 away from the chassis 202, a user contacts and applies a force to one or more of a top surface 404, a front tab 406, a rear tab 408, and/or a back surface 410 of the pen 402. The first guide 308 and the second guide 312 cooperate to translate the force applied to the pen 402 by a user to a pivot and/or rocking motion that allows the pen 402 to transition from the chassis 202 to the carriage 205 and into the installation position with little user manipulation. In other words, the pen 402 is guided across the gap 302 into an installation position by the geometric arrangement of the first and second guides 308, 312. This overall geometric arrangement (e.g., surface contours, relative tip positioning, gap distance, etc.) translate the applied, generally horizontal, force from the user in the directed motion, thereby reducing (e.g., eliminating) the need for the user to manipulate the pen 402. Instead, the user need only apply a forward, generally horizontal, force to the pen and the geometric construction of the guides 308, 312 will cause the pen to move downward, then upward into the installation position without catching on the gap 302. In the illustrated example, the gap 302 is shortened by moving the carriage 205 into the third loading position 224. Typically, the gap 302 is made larger (e.g., too large for a pen to traverse where the carriage 205 is in the first position 220 or the second position 222).

In the illustrated example, the chassis 202 has a ramp 412, which is integral to the chassis 202, to provide additional guidance to the pen 402 during installation. In the illustrated example, the pen 402 has a cutout or indentation 414 that provides clearance to allow the back of the pen 402 to rotate downward and/or displace in a direction towards a bottom surface of the imaging device 100 as the pen 402 moves across the gap 302 between the first and second guides 308, 312, thereby lifting the forward edge of the pen 402 and reducing the possibility of catching in the gap 302.

Figure 5A:
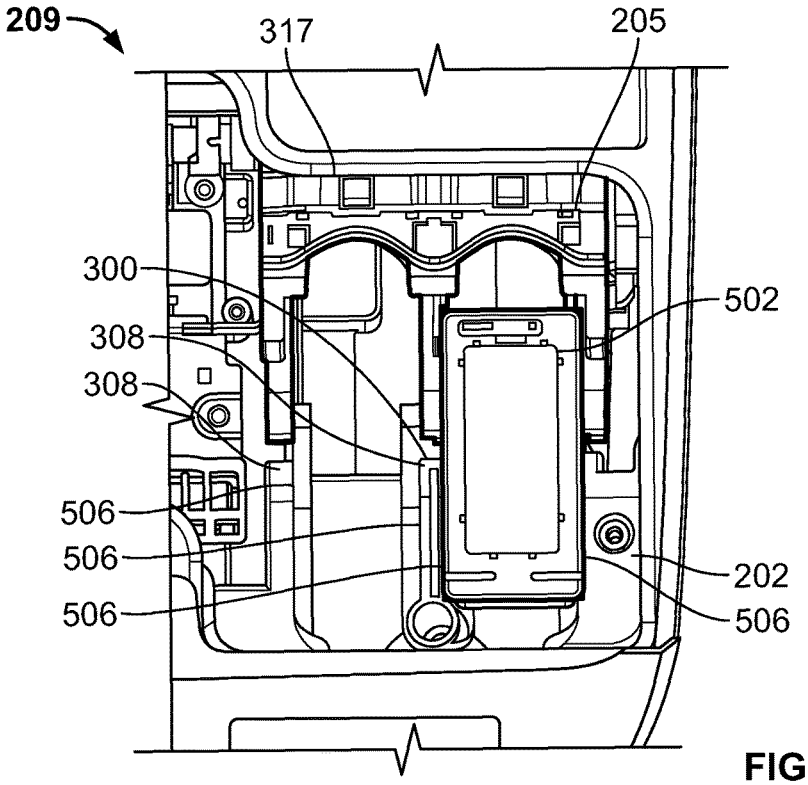
FIG. 5A is a top view of the example installation system of FIGS. 3 and 4 showing an extended length pen moving into an installed position.
Figure 5B:
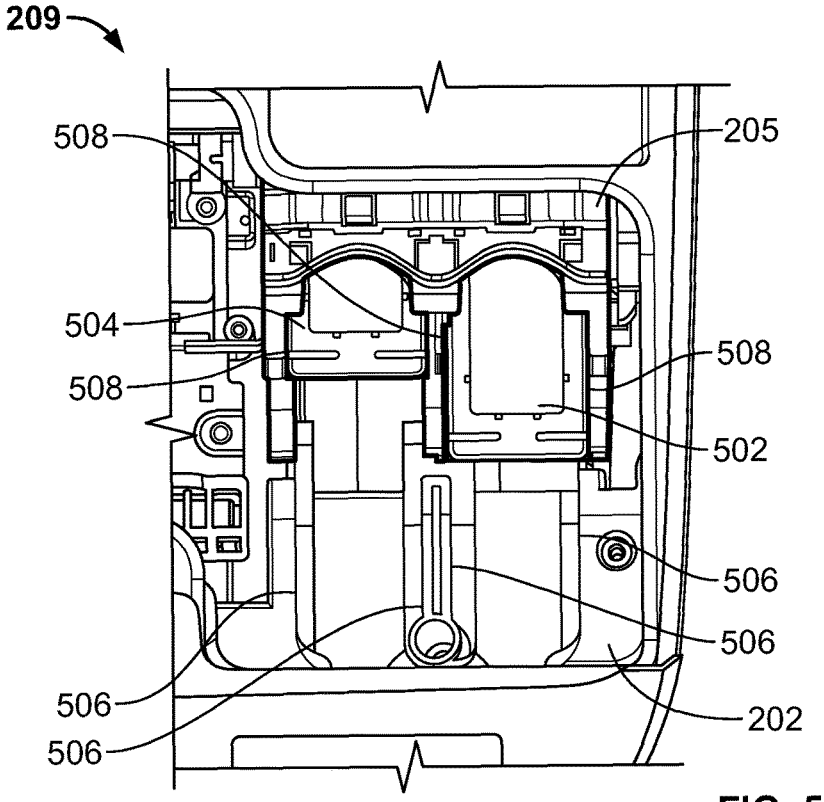
FIG. 5B is a top view of the example installation system of FIGS. 3 and 4, but showing the extended length pen and a normal sized pen in installed positions.

FIGS. 5A and 5B are top views of the example installation system 209 of FIGS. 3 and 4. Turning to FIG. 5A, an extended length pen 502 is shown moving between the chassis 202 and the carriage 205. As used herein, an extended length pen is a pen having a front to back dimension that is longer than a standard pen. The extended length pen 502 in the illustrated example is placed (e.g., dropped) into the opening 317 between the walls 506 by the user such that the pen 502 engages the first guides 308 of the chassis 202. In the illustrated example, the walls 506 define a highly visible and user-accessible opening so that the user can initiate installation by simply dropping the pen onto the first guides 308. In the illustrated example, the walls 506 initially position and/or align the pen 502 into the installation system 209 as the pen 502 falls onto the first guides 308. The installation system 209 of the illustrated example allows pens of different sizes (e.g., lengths) to be installed into the imaging device 100 by appropriately defining (e.g., dimensioning) an installation opening of the chassis 202 defined by lengths of the walls 506. In the illustrated example, the downwardly angled tip 300 of the first guides 308 has a rounded edge to further increase the smoothness of the transition of the pen onto the carriage 205. The user may contact the pen 502 at any one or more of numerous locations of the pen 502 to push the pen 502 into the installed position.

Turning to FIG. 5B, the extended length pen 502 and a regular length pen 504 are shown in their respective installed positions within the carriage 205. In the illustrated example, the walls 506 of the chassis 202, and the walls 508 of the carriage 205 constrain the pens 502, 504 from moving side-to-side during installation or removal of the pens 502, 504.

Figure 6:
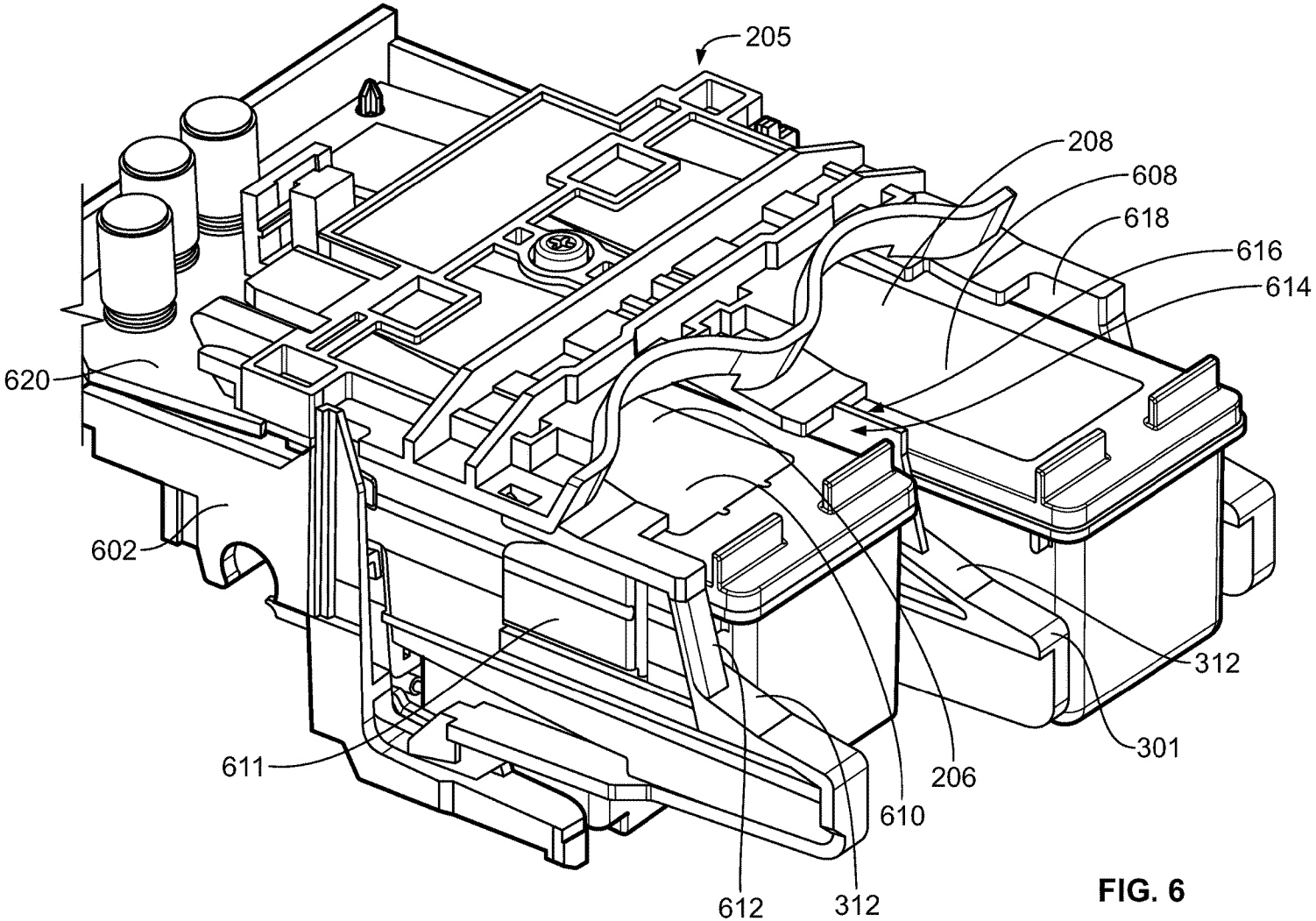
FIG. 6 depicts an example implementation of a carriage of the example installation system of FIGS. 3, 4, 5A and 5B showing a first pen and an extended length second pen in installed positions.

FIG. 6 depicts an example implementation of the carriage 205 of the example installation system 209 of FIGS. 3, 4, 5A and 5B showing an extended length pen 608 and a standard length pen 610 in installed positions. In the illustrated example, the carriage 205 includes a carriage base 602, and the pen chutes 206, 208 shown in connection with FIG. 2. In the illustrated example, the standard length pen 610 is installed in the pen chute 206 and the extended length pen 608 is installed in the pen chute 208. In some examples, the pen chutes 206, 208 have guiding features and springs to further guide the pens 608, 610 into their respective installed positions. The carriage 205 of the illustrated example of FIG. 6 has a strain-relief 611 component to provide additional reinforcement to the pen chute 206 as the pen 610 engages the second guides 312. In some examples, additional walls 612, 614, 616, 618 further constrain the pens in a side-to-side direction as the pens 608, 610 move into and/or out of their respective installation positions. The carriage 205 may also include circuitry 620 and/or motor(s) for operation of the carriage 205 during imaging operations or installation operations (e.g., to move the carriage 205 to the pen installation position 224 described in connection with FIG. 2).

Figure 7:
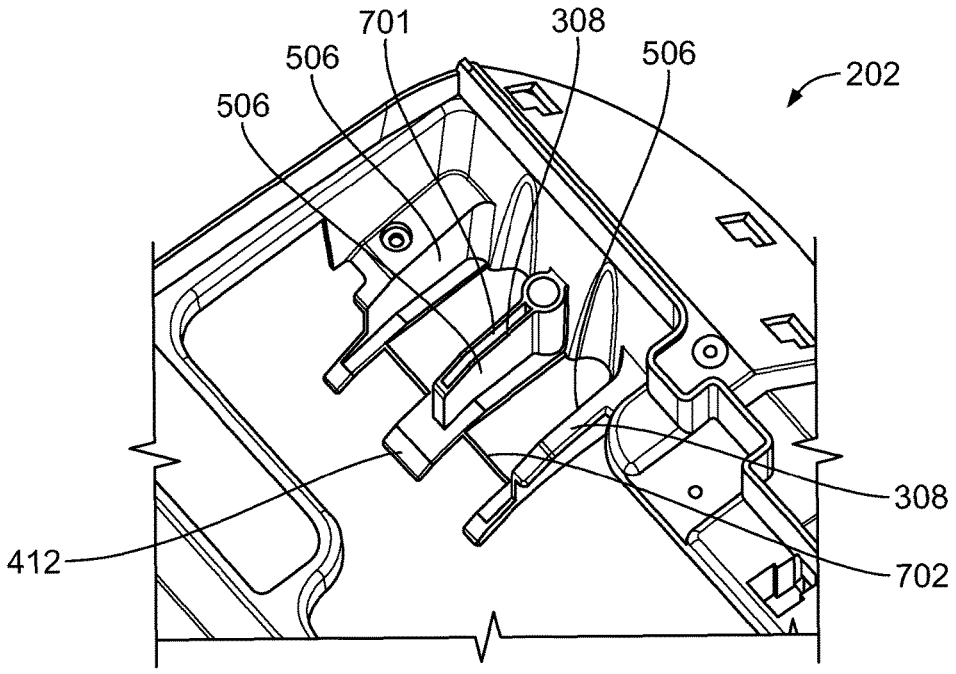
FIG. 7 depicts a portion of the chassis of the example installation system of FIGS. 3, 4, 5A and 5B.

FIG. 7 is a detailed view of a portion of the chassis 202 of the example installation system 209 of FIGS. 2, 3, 4, 5A and 5B. In this example, the walls 506 define the first guides 308. While the first guides 308 are shown as integrally formed (e.g., molded) with the walls 506, in other examples, the first guides 308 are separate components and/or formed by additional processing (e.g., machining, etc.). As described in connection with FIG. 5A, the walls 506 of the illustrated example define a visible and intuitive installation area in which a user may simply drop a pen onto the first guides 308. The chassis 202 of the illustrated example defines an opening 702 to allow the rear of the pen to displace downward towards the bottom of the imaging device 100 as the pen transitions from the chassis 202 to the carriage 205. The opening 702 may be formed when the chassis 202 is molded. In the illustrated example, the walls 506 are separated by a cavity 701 to allow greater manufacturing flexibility and/or allow the walls 506 to elastically displace during installation of the pen. In some other examples, one or more of the above-mentioned features including the first and/or second guides 308, 312, the ramp 412 and/or the opening 702 are formed as part of the base 102 described in connection with FIGS. 1 and 2. In other examples, the first and/or second guides 308, 312 and/or the ramp 412 are constructed of separate parts that are fastened and/or assembled onto the chassis 202 and/or the base 102.

Figure 8A:
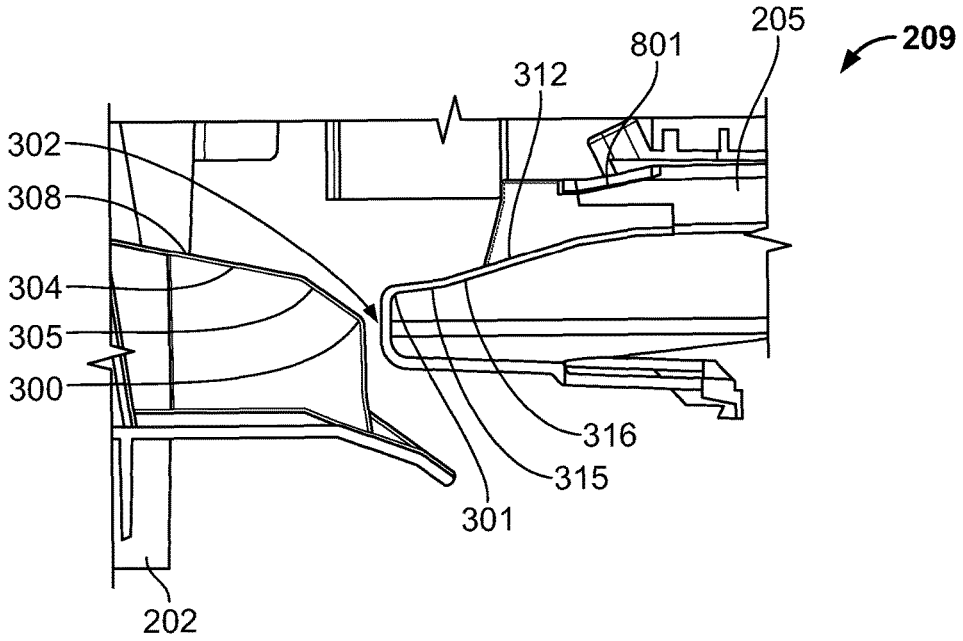
FIG. 8A is a cross-sectional side view of the example installation system of FIGS. 3, 4, 5A and 5B.

FIG. 8A is a cross-sectional side view of the example installation system 209 of FIGS. 3, 4, 5A and 5B. In the illustrated example, an installation path of a pen is defined by the first downwardly sloped surface 304, the second downwardly sloped surface 305, the gap 302, the first upwardly sloped surface 315 and the second upwardly sloped surface 316. In the illustrated example of FIG. 8A, the downwardly angled tip 300 of the first guides 308 of the chassis 202 and the upwardly angled tip 301 of the carriage 205 in the illustrated example of FIG. 8A are positioned in both a horizontal offset and a vertical offset relative to one another to define the gap 302. As described above, the geometric construction of the first and second guides 308, 312 facilitates the movement of the pen from the first guides 308 to the second guides 312 (e.g., bridging the downwardly angled tip 300 and the upwardly angled tip 301) by allowing a kinematic transition (e.g., rotation and/or movement) of the pen as the pen is transferred into an installation position of the pen. In the illustrated example, additional guides 801, which are integral with the carriage 205, are included in the installation system 209 to further guide the pen to transition across the gap and/or into the installation position of the pen as the pen moves along one or more of the first upwardly sloped surface 315 or the second upwardly sloped surface 316.

Figure 8B:
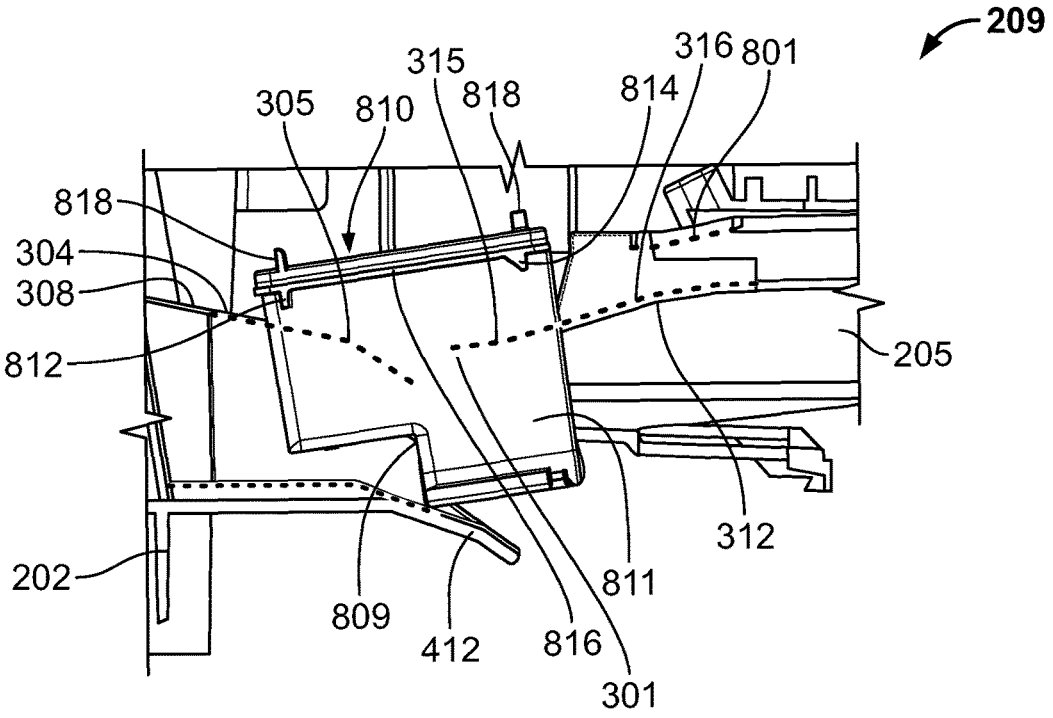
FIG. 8B is another cross-sectional side view of the example installation system of FIGS. 3, 4, 5A and 5B showing a pen in a first position during an installation process.
Figure 8C:
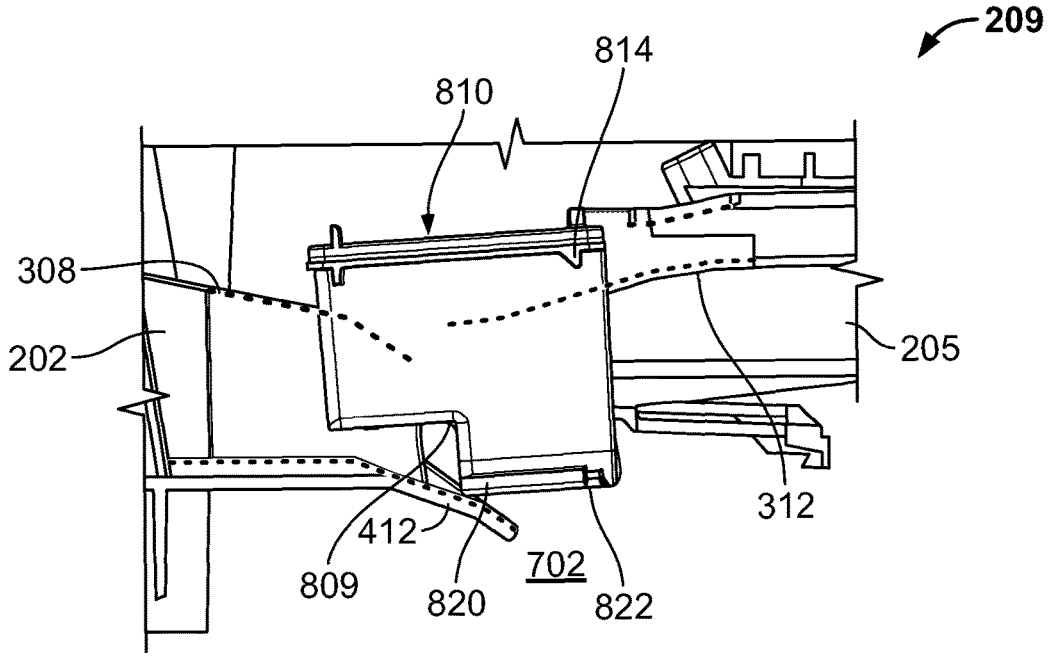
FIG. 8C is a view similar to FIG. 8B but showing the pen in a second position during the installation process.

FIGS. 8B and 8C are additional cross-sectional side views of the example installation system 209 of FIGS. 3, 4, 5A, 5B and 8A shown during installation of a pen 810. Turning to FIG. 8B, the pen 810 is shown transitioning from the chassis 202 to the carriage 205. In the illustrated example, a portion 811 of the pen 810 is shown raised relative to the surfaces 315, 316 of the second guides 312 and the upwardly angled tip 301 to prevent the pen 810 from catching during the transition (e.g., catching or getting trapped from entering the carriage 205). The pen 810 of the illustrated example is raised relative to the surfaces 315, 316 of the second guides 312 due to a rear portion of the pen 810 defined by an indentation 809 rotating downward relative to the ramp 412. In other words, in the illustrated example, the first and second guides 308, 312 and/or the ramp 412 prevent catching of the pen 810 by raising the first (e.g., front) end of the pen 810 relative to the upwardly angled tip 301 of the second guides 312.

The pen 810 of the illustrated example has one or more tab(s) (e.g., protrusion(s)) 812 to contact one or more of the first downwardly sloped surface 304, the second downwardly sloped surface 305, the first upwardly sloped surface 315 and/or the second upwardly sloped surface 316. In the illustrated example, the tab 812 first contacts the first downwardly sloped surface 304 when the pen 810 is placed onto the first guides 308. In the illustrated example, the tab 812 then contacts the second downwardly sloped surface 305 at a steeper angle relative to horizontal before entering the gap 302. After the tab 812 of the illustrated example traverses the gap 302, the tab 812 then contacts the first upwardly sloped surface 315 of the carriage 205. In the illustrated example, the tab 812 contacts the second upwardly sloped surface 316 prior to the pen 810 moving into the installation position. In the illustrated example, the tab 814 contacts the first upwardly sloped surface 304 or the second upwardly sloped surface 305 when the pen 810 is first placed on the first guides 308 depending on the length of the pen 810. In other examples, the tab 814 does not initially contact one of the first downwardly sloped surface 304 or the second downwardly sloped surface 305 and, instead, initially contacts the first upwardly sloped surface 315. In the illustrated example, as the pen 810 moves across the gap, the tab 814 first contacts the first upwardly sloped surface 315 prior to contacting the second upwardly sloped surface 316, which transitions the pen 810 into a less steep angle relative to horizontal prior to the pen 810 entering the installed position. In other examples, the pen 810 does not have the tabs 812, 814 and instead relies on an edge 816 of an upper perimeter of the top of the pen 810 to contact one or more of the first downwardly sloped surface 304, the second downwardly sloped surface 305, the first upwardly sloped surface 315, and/or the second upwardly sloped surface 316. In the illustrated example, the pen 810 has upper tabs 818 to contact and/or be constrained by the additional guides 801 described in connection with FIG. 8A. The additional guides 801 of the illustrated example provide further guidance to the pen 810 by contacting the upper tabs 818 and/or a top perimeter or other top surface of the pen 810 to constrain the pen 810 from displacing upward as the pen moves into the installation position. The upper tabs 818 of the illustrated example also function as grip points for the user during installation or removal of the pen 810.

Turning to FIG. 8C, the pen 810 of the illustrated example is shown in a second position along the installation path during the installation process (i.e., closer to the installation position than the position of the pen 810 shown in FIG. 8B). A pen bottom edge 820 contacts and slides along the ramp 412 as the pen 810 transitions from the first guides 308 to the second guides 312, thereby allowing a bottom portion 822 of the pen 810 to move into the opening 702 described in connection with FIG. 7. The bottom portion 822 of the illustrated example pen 810 contains a fragile silicon plate. Contact with the fragile silicon plate is avoided due to the clearance provided by the opening 702. In the illustrated example, the downward slope of the ramp 412, the opening 702 and/or the indentation 809 of the pen 810 allow the tab 814 to move downward in relation to the position shown in FIG. 8B and towards the second guides 312 where the pen 810 rotates as the pen 810 is moved from the first and second guides 308, 312 to initially contact the first upwardly sloped surface 315 or the second upwardly sloped surface 316 of the second guides 312 as the pen moves from the chassis 202 and towards the carriage 205. In particular, the clock-wise rotation (e.g., clockwise to the orientation viewed in FIG. 8C) of the pen 810 caused by the bottom portion 822 of the pen 810 moving into the opening 702 moves the tab 814 closer to the second guides 312.

The installation system 209 of the illustrated example translates vector components of the user applied forces to reduce manipulation required by the user of the pen 810 during installation, thereby increasing ease of installation of the pen 810 into the imaging device. Additionally, for removal of the pen 810, the user is only required to guide the pen 810 in an opposite direction from the installation path, thereby returning the pen 810 towards the chassis 202 and into a user-accessible position.

From the foregoing, it will be appreciated that methods, apparatus and/or articles of manufacture have been disclosed to facilitate easier installation of pens into imaging devices while reducing manufacturing complexity and/or part cost. Improved ease of installation may result in reduced returns and/or service calls related to the imaging device and/or the pens. Additionally, example methods, apparatus and/or articles of manufacture disclosed herein allow greater design flexibility and/or aesthetics for the imaging devices (e.g., no large opening is required in the front of the imaging device). Examples disclosed herein also exhibit increased ease of installation also apply to removal of the pens from the imaging device as the user simply moves the pen in a direction opposite from the installation motion to easily move a pen out of the imaging device with relatively no manipulation of the pen.

Although certain example apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a first guide on a first component of an imaging device to support a top portion of a pen and to guide the pen in a first direction toward a second component of the imaging device during installation of the pen in the imaging device;

a second guide on the second component to receive the pen from the first guide during the installation of the pen, the first guide and the second guide defining a gap therebetween, at least one of the first and second guides to cause the pen to pass the gap without catching, the second guide to guide the pen into an installed position in the second component; and a ramp on the first component to support a bottom portion of the pen during transition from the first guide to the second guide, the ramp to facilitate rotation of the pen to direct the pen onto the second guide.

2. The apparatus as defined in claim 1, wherein the first component comprises a chassis.

3. The apparatus as defined in claim 1, wherein the second component comprises a carriage defining a pen chute.

4. The apparatus as defined in claim 3, wherein the carriage has first and second positions for operation of the imaging device, and a third position for installation of pens into the imaging device.

5. The apparatus as defined in claim 1, wherein the gap separates the first guide and the second guide in both horizontal and vertical directions.

6. The apparatus as defined in claim 1, wherein the first guide comprises a first downwardly sloped surface and a second downwardly sloped surface, the first downwardly sloped surface having a smaller slope from the second downwardly sloped surface.

7. The apparatus as defined in claim 1, wherein the second guide comprises a first upwardly sloped surface and a second upwardly sloped surface, the first upwardly sloped surface having a larger slope from the second upwardly sloped surface.

8. The apparatus as defined in claim 1, wherein one or more of the first guide and the second guide cause the pen to rotate backward then forward as it moves into the installed position.

9. The apparatus as defined in claim 1, further comprising a third guide to prevent an upward motion of the pen.

10. An imaging device comprising:

a first guide to support a top portion of a pen and to guide the pen in a first direction toward a carriage of the imaging device during installation of the pen in the imaging device, the carriage to move relative to a chassis of the imaging device during an imaging operation;

a second guide to receive the pen from the first guide and to guide the pen into an installed position in the carriage during the installation of the pen, the first guide and the second guide being separated by a gap, and at least one of the first guide and the second guide to cause the pen to rotate backwards then forward to bridge the gap; and a ramp on the chassis to support a bottom portion of the pen during transition from the first guide to the second guide.

11. The imaging device as defined in claim 10, wherein the gap is defined by both horizontal and vertical offsets between tops of the first and second guides.

12. The imaging device as defined in claim 10, wherein the carriage has first and second positions for operation of the imaging device, and a third position for installation or removal of the pen into the imaging device.

13. The imaging device as defined in claim 10, further comprising a third guide to restrain an upward motion of the pen.

14. The imaging device as defined in claim 10, wherein the first guide comprises a first downwardly sloped surface and a second downwardly sloped surface, the first downwardly sloped surface having a smaller slope from the second downwardly sloped surface.

15. The imaging device as defined in claim 10, wherein the second guide comprises a first upwardly sloped surface and a second upwardly sloped surface, the first upwardly sloped surface having a larger slope from the second upwardly sloped surface.

16. The imaging device as defined in claim 10, wherein one or more of the first guide and the second guide cause the pen to rotate backward then forward as it moves into the installed position.

* * * * *